US006012427A

United States Patent [19]

Hoy et al.

[11] Patent Number: 6,012,427

[45] Date of Patent: Jan. 11, 2000

[54] INTERNAL COMBUSTION ENGINE SPARK SCHEDULING

[75] Inventors: Alan Hoy, Chelmsford; Jon Dixon, Maldon, both of United Kingdom

[73] Assignee: Ford Global Technologies, Inc., Dearborn, Mich.

[21] Appl. No.: 09/087,590

[22] Filed: May 29, 1998

[30] Foreign Application Priority Data

May 30, 1997 [GB] United Kingdom ..... 9711137

[51] Int. Cl.[7] ..... F02P 5/15

[52] U.S. Cl. ..... 123/406.5; 123/406.6; 123/406.58

[58] Field of Search ..... 123/406.61, 406.6, 123/406.59, 406.58, 406.51, 406.5; 701/105

[56] References Cited

U.S. PATENT DOCUMENTS

| | | | |
|---|---|---|---|
| 3,915,131 | 10/1975 | Brungsberg | 123/406.59 |
| 4,426,974 | 1/1984 | Nash | 123/406.6 |
| 4,487,183 | 12/1984 | Petrie | 123/406.59 |
| 5,099,811 | 3/1992 | Frantz et al. | 701/105 |
| 5,184,590 | 2/1993 | Hashimoto et al. | 123/406.58 |
| 5,467,752 | 11/1995 | Murao et al. | 123/406.6 |

FOREIGN PATENT DOCUMENTS 2 043 171 11/1980 United Kingdom .

*Primary Examiner*—Tony M. Argenbright
*Assistant Examiner*—Arnold Castro
*Attorney, Agent, or Firm*—Allan J. Lippa

[57] ABSTRACT

The present invention relates to apparatus for scheduling the ignition sparks for a spark ignition internal combustion engine. An ignition system for a spark ignition engine, includes a device for generating a series of pulses (12) upon each revolution of a crankshaft (1) and a device (8,118) for identifying pulses in the series relative to a top dead center position (TDC) for the engine, one or more ignition coils and a device to charge a coil and then to discharge the coil to generate an ignition spark at a desired spark angle (54) relative to the top dead center position (TDC). The ignition system identifies a first particular pulse (60) occurring after the charging starts and before the discharging begins, and calculates a first interval ($I_D$) from the first particular pulse (60) so that the discharging happens proximate the desired spark angle (54).

9 Claims, 2 Drawing Sheets

INTERNAL COMBUSTION ENGINE SPARK SCHEDULING

Figure 1:
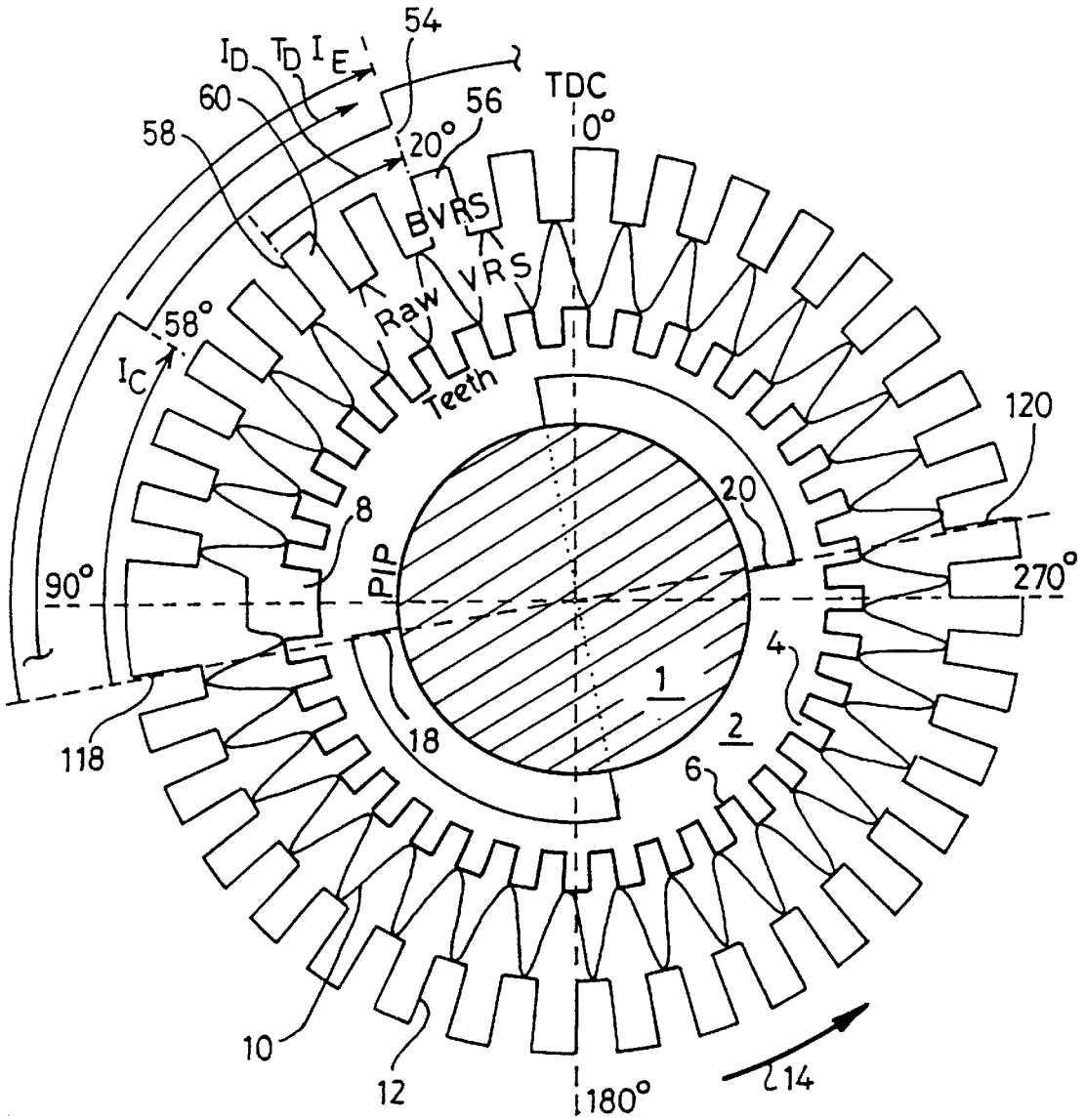

The present invention relates to apparatus for scheduling the ignition sparks for a spark ignition internal combustion engine.

Ignition sparks for internal combustion engines are conventionally scheduled using either mechanical distributors or more reliable electronic ignition systems. A coil must be charged during a dwell time and then discharged to ignite the fuel in a cylinder at a time corresponding to the correct spark angle relative to the engine top dead center position. It is often desirable to alter either the dwell time or the spark angle depending on the engine operating characteristics.

One way of doing this is disclosed in patent document GB 2 043 171 A, which employs an electronic ignition system in which a duration of time is calculated from a previous ignition cycle to the start of coil charging for the present ignition cycle. Another system is disclosed in U.S. Pat. No. 5,467,752 in which two or more timing reference points are provided before top dead center for the present ignition cycle. The start time for coil charging is calculated backwards in terms of engine angle from the one of these reference points that results in the least error in spark angle. If the coil charging time becomes too short, the ignition time is delayed after the desired spark angle so that the coil can at least store a minimum amount of charge.

Electronic systems such as the above offer greater flexibility than mechanical systems in controlling the coil charging and discharging, but problems remain in scheduling the spark event. In particular, if the engine speed is changing rapidly, for example, during revving up or while braking, the actual spark angle may be shifted appreciably from the desired spark angle, because the electronic ignition calculates the correct point in time for the coil discharge on the assumption that engine speed is constant.

The scheduling of spark events is usually calculated with reference to a known orientation, or "angle", of the engine cylinders. For example the engine angle may be known at two positions, 180° apart, from a toothed wheel and sensor arrangement on the engine crankshaft. While such an arrangement gives good performance at relatively constant engine speeds, the spark angle may become shifted at varying conditions. For example, engine speed may change by up to 2% over a 90° engine angle, and if this angle corresponds to the time taken from the time at which the spark event is scheduled to the discharge time, then the discharge time will be out by about 7°. This is a significant error and will result in non-optimal firing of the engine cylinders.

It is an object of the present invention to provide an ignition system which provides a more accurate control of the spark angle and, optionally, of the dwell time.

Accordingly, the present invention provides an ignition system for a spark ignition engine, comprising means for generating a series of pulses upon each revolution of the engine and means for identifying pulses in the series relative to a top dead center position for the engine, one or more ignition coils and means to charge a coil and then to discharge the coil to generate an ignition spark, characterised in that the ignition system comprises means to identify a first particular pulse occurring after the charging starts and before the discharging begins, and means to calculate a first interval from the first particular pulse so that the discharging happens proximate a desired spark angle relative to the top dead center position.

The discharging may then happen well within 7° of the desired spark angle, even when the engine is accelerating.

Preferably, the discharging is proximate to the desired spark angle to within about 2°.

The desired spark angle may need to be varied, for example, increasing at higher engine speeds.

The pulses may be electrical or optical. In the case of features or teeth cast into a crankshaft, the sensor may be a variable reluctance sensor producing a generally sinusoidal series of electrical pulses, with at least one pulse being identifiable, for example having a different width or occurring after a missing pulse. Such pulses may then be digitised in a known manner for input into an electronic ignition system, which may be based on a microprocessor that determines the first interval and, optionally the dwell time.

In general the greater the number of pulses during one revolution of the crankshaft, the greater the accuracy will be in scheduling the coil discharge relative to the desired spark angle. It is therefore advantageous if the series of pulses comprises at least about nine pulses. However, using too great a number of pulses may provide a negligible benefit. Therefore the series of pulses should comprise no more than about 360 pulses.

Also in general, the closer in the time the first particular pulse is prior to the spark event the greater the accuracy will be in scheduling the coil discharge relative to the desired spark angle. It may therefore be advantageous always to use as the first particular pulse the pulse immediately proceeding the time corresponding to the desired spark angle. However, for a moderate number of pulses, for example of the order of thirty-six, there may be insufficient time at higher engine speeds for a microprocessor to calculate the correct first interval and to initiate the discharge of the coil at the desired spark angle. In any event, there may be an insignificant benefit associated with the decreased interval at higher engine speeds. Therefore, it is particularly advantageous if the first particular pulse is selected from amongst a plurality of pulses by the means to identify the first particular pulse, so that the first interval remains above a minimum interval as the engine speed increases.

In a similar manner to that described above for scheduling the spark event, the start of coil charging may also be scheduled, according to a desired dwell time. Depending on the time taken between the time at which an engine management system the time taken from the time at which the start of coil charging is scheduled to the actual time at which coil charging starts, engine speed variations may alter the actual dwell time.

Variations in dwell time due to engine speed changes are not as serious as variations between desired and actual spark angle because the coil charging can be such that the nominal coil charge is more than sufficient to ignite a cylinder under all normal conditions. However, it may still be desired to be able to control the dwell time and hence the coil charging more accurately in order to deliver a more optimal amount of energy to ignite the cylinder. Dwell time may also need to be varied, in order to provide optimal energy in a spark, according to various factors, such as battery voltage and coil temperature.

In a similar manner to that described above for scheduling the spark event, the ignition system may therefore comprise means to identify a second particular pulse occurring before the charging starts, and means to calculate a second interval from the second particular pulse so that the charging begins at the desired dwell time prior to the beginning of discharge.

Similarly again, the second particular pulse may be selected from amongst a plurality of pulses by the means to identify the second particular pulse, so that the second interval remains above a minimum interval as the engine speed increases.

If the ignition system comprises means to calculate a desired spark angle according to engine operating parameters, then the first, and optionally the second, intervals or particular pulses may be then be appropriated calculated or selected by the ignition system.

In a preferred embodiment of the invention, the means for generating the series of pulses upon each revolution of the engine comprises a toothed wheel turned by the crankshaft. A sensor may then sense each tooth passing the sensor and outputs a series of analogue or digital pulses, the wheel having at least one reference feature such as a reference tooth (or gap between teeth) which produces a reference pulse as the reference feature passes the sensor. In this way each pulse in the series of pulses may be identified relative to the engine top dead center position.

Also according to the invention, there is provided a method of generating an ignition spark for a spark ignition engine, comprising the steps of: generating a series of pulses upon each revolution of the engine; identifying pulses in the series relative to a top dead center position for the engine; initiating charging of an ignition coil; and discharging the ignition coil to generate an ignition spark; characterised in that the method comprises the steps of: identifying a first particular pulse after the charging starts and before discharging begins; and calculating a first interval, from the first particular pulse so that the discharging happens proximate a desired spark angle relative to the top dead center position.

Figure 2:
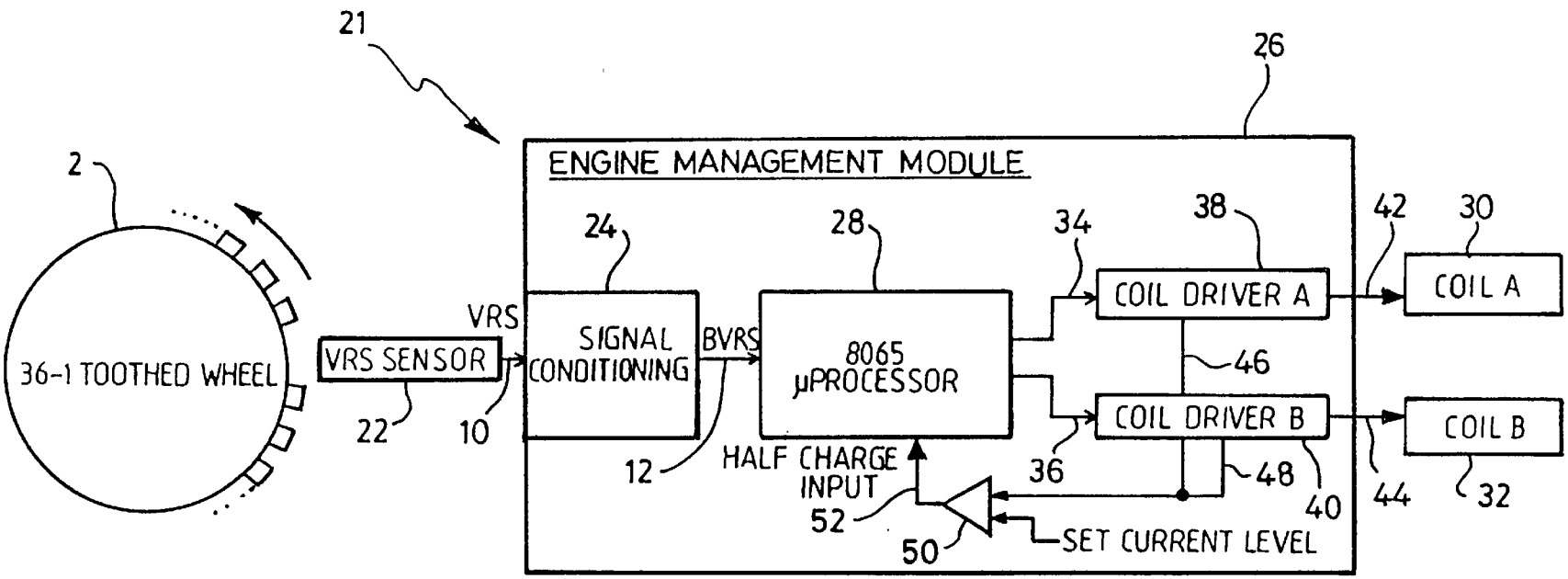

The invention will now be further described by way of example only, with reference to the accompanying drawings, in which:

FIG. 1 is a schematic representation of a toothed wheel, showing the series of pulses and the scheduling of the spark event and dwell time according to the invention; and FIG. 2 is a schematic block diagram of an ignition system according to the invention having as its input the series of pulses of FIG. 1.

Referring first to FIG. 1, a crankshaft 1 has secured around its periphery a toothed wheel 2. The toothed wheel 2 has positions for thirty-six evenly spaced teeth 4 with gaps 6 of equal width to the teeth therebetween. Each tooth and gap therefore represents 5° of angle. One of the thirty-six teeth is missing, leaving a gap 8 three times longer than the other gaps 6. The gap 8 is therefore equivalent to 15° of crankshaft rotation.

A variable reluctance sensor, or VRS, (not shown) produces a raw sinusoidal VRS output signal 10, which is inverted and digitized into a buffered VRS signal, or BVRS 12. Each of the thirty-five pulses in the BVRS signal therefore has a period equivalent to 10° of crankshaft rotation.

The toothed wheel rotates anticlockwise, as indicated by the arrow 14 and is illustrated for convenience with top dead center (TDC) at the top of the drawing.

The start of the 15° gap 8 for the missing tooth is set to occur at 100° before TDC. This is purely for convenience owing to the fact that a prior art toothed wheel, shown on FIG. 1 as PIP (for Profile Ignition Pickup) provided two pulses per revolution on the crankshaft, with edges 18,20 respectively at 100° before TDC and at 80° after TDC. The prior art system used one or the other of these PIP pulses to schedule both the start of charging and beginning of the spark discharge. The preferred embodiment of the invention described hereinafter uses reference edges 118,120 of one or the other of the BVRS pulses at the same angles to schedule the start of charging of the coil.

Referring now to FIG. 2, which shows a preferred embodiment of an ignition system 21, the so-called "36-1 toothed wheel" 2 rotates past a VRS sensor 22 to produce the raw VRS signal 10, which is passed to a buffering input 24 of an engine management module 26. The module comprises a microprocessor unit 28 based on an 8065 chip manufactured by Intel Corporation. Using the input BVRS signal 12 the microprocessor unit calculates (as will be explained in more detail below) the correct time for the start of charging and the beginning of discharging, of one or the other of a pair of coils 30,32 and supplies a digital output signal 34,36 to one or the other of a pair of coil drivers 38,40, which in turn produce drive signals 42,44 for the coils 30,32.

Each coil driver also produces an analog output 46,48 passed to a comparator 50, which supplies a digital output 52 to the microprocessor 28 which goes high when either one or the other of the coils has been charged half way. The dwell time $T_D$ to charge the coil may vary depending on a number of factors, particularly the battery voltage and the coil resistance, which is a function of coil temperature. Therefore, the signal microprocessor 28 uses the digital signal 52 to calculate an expected or predetermined dwell time for charging the coil.

Referring now also to FIG. 1, the microprocessor will aim to discharge the coil at a particular desired spark angle 54, here 20°. The expected dwell time $T_D$ terminates in the discharge of the coil and the spark event. The frequency with which the BVRS pulses reach the microprocessor 28 is a measure of the engine speed at a given instant, and from this, the microprocessor 28 can determine an expected time interval $I_E$ starting from the detected edge 118 of the BVRS signal until the occurrence of the desired spark angle 54. Since the dwell time $T_D$ is predetermined, a time interval $I_C$ from the edge 118 to the start of charging is also known, and the microprocessor 28 therefore begins to charge the coil at this time. In this example, this time interval begins at 58° before TDC.

If the engine speed is constant, then after the predetermined dwell time $T_D$ the engine will be at the correct spark angle. However, if the engine speed has varied between the detection of the edge 118 and the end of the expected interval $I_E$, then the engine will not be at the correct spark angle after the predetermined dwell time $T_D$. In order to schedule the spark event at the desired spark event, the microprocessor therefore selects a particular pulse in the series of BVRS pulses occurring after the start of charging and before the end of the expected interval $I_E$. In order to allow enough time for the microprocessor to complete its real-time control of the coil discharge, it is here not desirable to select the pulse 56 immediately preceding the pulse during which the spark event will occur; instead the microprocessor selects the leading edge 58 of the penultimate pulse 60 prior to that pulse 56 as the basis for calculating a time interval, referred to hereinafter as a discharge interval $I_D$, ending in the discharge of the coil. The penultimate pulse is therefore the 'first particular pulse' mentioned above occurring after charging starts and before discharging beings from which the 'first interval' is calculated.

The discharge interval $I_D$ is calculated based on the measured engine speed as determined by the frequency of the BVRS pulses immediately preceding the penultimate pulse 56, and from the angle, here 20°, calculated between the desired spark angle 54 and the penultimate pulse leading edge 58. The discharge of the coil is then scheduled at the end of the discharge interval $I_D$.

The above description is the case at low engine speeds. At moderate engine speeds, the time interval $I_C$ from the edge 118 to the start of charging will become small, and at maximum engine speed, the start of charging may need to begin at angles in excess of 270°. Therefore, depending on the frequency of the BVRS pulses, the microprocessor 28 selects one or the other of the BVRS pulse reference edges 118,120 from which to base its calculation of the expected interval $I_E$ and the time interval $I_C$ to start of charging. One of the pulses associated with the BVRS reference edges 118,120 is therefore the 'second particular pulse' mentioned above occurring before charging starts from which the 'second interval' is calculated.

Similarly, in order to avoid the discharge interval $I_D$ from becoming too small, pulses progressively further from the pulse 56 at the spark angle are selected by the microprocessor 28 for the calculation of the discharge interval $I_D$. At a maximum engine speed of the order of 6500 rpm, the pulse from which the interval $I_D$ is calculated may be up to 60° prior to the desired spark angle.

If the engine speed varies significantly between a reference edge 118,120 and the start of charging, then the dwell time $T_D$ may, for larger time intervals $I_C$ vary from its optimum value. This however, is not a particular problem as long as the nominal coil charge is sufficiently beyond a minimum level. It would, however, be possible to ensure that the dwell time was more optimal by selecting one of the BVRS pulses prior to the start of coil charging, for example a penultimate prior pulse, in a similar manner to that described above for scheduling the coil discharge.

An ignition system as described above may be used to improve the control of the spark angle and, optionally, of the dwell time. The ignition system improves scheduling of the spark event, and optionally the amount of coil charging when the engine speed is varying significantly.

We claim:

1. An ignition system for a spark ignition engine, comprising means (2,10,22,24) for generating a series of pulses (12) upon each revolution of the engine and means (28) for identifying pulses in the series (12) relative to a top dead center position (TDC) for the engine, one or more ignition coils (30,32) and means to charge a coil (38,40) and then to discharge the coil (38,40) to generate an ignition spark, characterized in that the ignition system comprises means (28) to identify a first particular pulse (60) occurring after the charging starts and before the discharging begins, and means (28) to calculate a first interval (ID) from the first particular pulse (60) so that the discharging happens proximate a desired spark angle (54) relative to the top dead center position (TDC), in which the first particular pulse (60) is selected from amongst a plurality of pulses (12) by the means (28) to identify the first particular pulse (60), so that the first interval ($I_D$) remains above a minimum interval as the engine speed increases.

2. An ignition system as claimed in claim 1, in which the time between the start of charging and beginning of discharge corresponds to a desired dwell time ($T_D$), the ignition system comprising means (28) to identify a second particular pulse (8) occurring before the charging starts, and means (28) to calculate a second interval ($I_C$) from the second particular pulse (8) so that the charging begins at the desired dwell time ($T_D$) prior to the beginning of discharge.

3. An ignition system as claimed claim 2, in which the second particular pulse (8) is selected from amongst a plurality of pulses (12) by the means (28) to identify the second particular pulse (8), so that the second interval ($T_C$) remains above a minimum interval as the engine speed increases.

4. An ignition system as claimed in claim 3, in which the series of pulses (12) comprises at least nine pulses.

5. An ignition system as claimed in claim 3, in which the series of pulses (12) comprises no more than 360 pulses.

6. An ignition system as claimed in claim 3, in which the ignition system comprises means (28) to calculate a desired spark angle (54) according to engine operating parameters.

7. An ignition system as claimed in claim 6, in which the means (28) for generating the series of pulses upon each revolution of the engine comprises a toothed wheel (2) turned by the crankshaft (1), a sensor (22) which senses each tooth (4) passing and from which the series of pulses (12) is generated, the wheel (2) having at least one reference feature (8) which produces a reference pulse as the reference feature (8) passes the sensor (22).

8. An internal combustion engine comprising an ignition system as claimed in claim 7.

9. A method of generating an ignition spark for a spark ignition engine, comprising the steps of:

i) generating (2,10,22,24) a series of pulses (2) upon each revolution of the engine;

ii) identifying (28) pulses in the series (12) relative to a top dead center position (TDC) for the engine;

iii) initiating (28) charging of an ignition coil (38,40); and iv) discharging (28) the generate an ignition spark; characterized in that the method comprises the steps of:

v) identifying (28) a first particular pulse (60) after the charging starts and before discharging begins; and vi) calculating (28) a first interval ($I_a$) from the first particular pulse (60) so that the discharging happens proximate a desired spark angle (54) relative to the top dead center position (TDC), in which the first particular pulse (60) is selected from amongst a plurality of pulses (12) by the means (28) to identify the first particular pulse (60), so that the first interval ($I_D$) remains above a minimum interval as the engine speed increases.

* * * * *